US009263055B2

(12) United States Patent
Agiomyrgiannakis et al.

(10) Patent No.: US 9,263,055 B2
(45) Date of Patent: Feb. 16, 2016

(54) SYSTEMS AND METHODS FOR THREE-DIMENSIONAL AUDIO CAPTCHA

(71) Applicant: Google Inc., Mountain View, CA (US)

(72) Inventors: Yannis Agiomyrgiannakis, London (GB); Edison Tan, Brooklyn, NY (US); David John Abraham, Brooklyn, NY (US)

(73) Assignee: Google Inc., Mountain View, CA (US)

( * ) Notice: Subject to any disclaimer, the term of this patent is extended or adjusted under 35 U.S.C. 154(b) by 327 days.

(21) Appl. No.: 13/859,979

(22) Filed: Apr. 10, 2013

(65) Prior Publication Data

US 2014/0307876 A1 Oct. 16, 2014

(51) Int. Cl.
*G10L 21/003* (2013.01)
*H04R 5/04* (2006.01)

(52) U.S. Cl.
CPC ..... *G10L 21/003* (2013.01); *H04R 5/04* (2013.01)

(58) Field of Classification Search
CPC . G06F 21/31; G06F 21/32; G06F 2221/2133; G10L 21/0364; G10L 21/003; H04R 27/00; H04R 2227/003; G10K 15/02
USPC ..... 381/1, 17–19, 300, 306, 309, 310, 63, 381/66
See application file for complete search history.

(56) References Cited

U.S. PATENT DOCUMENTS 6,178,245 B1 1/2001 Starkey et al.
7,536,021 B2 * 5/2009 Dickins ..... H04S 3/004 381/310
8,036,902 B1 10/2011 Strom et al.
2003/0007648 A1 * 1/2003 Currell ..... H04S 7/30 381/61
2009/0046864 A1 2/2009 Mahabub et al.
2009/0293119 A1 11/2009 Jonsson
2009/0319270 A1 * 12/2009 Gross ..... G10L 17/26 704/246
2010/0049526 A1 2/2010 Lewis et al.
2011/0305358 A1 12/2011 Nishio et al.

(Continued)

FOREIGN PATENT DOCUMENTS

EP 0760197 1/2009

OTHER PUBLICATIONS

Bigham et al., "Evaluating Existing Audio CAPTCHAs and an Interface Optimized for Non-Visual Use", Conference on Human Factors in Computing Systems, Apr. 2009, Boston, MA, 20 pages.
ITU-T, Geneva, Recommendation P.56, Objective Measurement of Active Speech Level, Mar. 1993, 24 pages.

(Continued)

*Primary Examiner* — Vivian Chin
*Assistant Examiner* — David Ton
(74) *Attorney, Agent, or Firm* — Dority & Manning, P.A.

(57) ABSTRACT

Systems and methods for generating and performing a three-dimensional audio CAPTCHA are provided. One exemplary system can include a decoy signal database storing a plurality of decoy signals. The system also can include a three-dimensional audio simulation engine for simulating the sounding of a target signal and at least one decoy signal in an acoustic environment and outputting a stereophonic audio signal based on the simulation. One exemplary method includes providing an audio prompt to a resource requesting entity. The audio prompt can have been generated based on a three-dimensional audio simulation of the sounding of a target signal containing an authentication key and at least one decoy signal in an acoustic environment. The method can include receiving a response to the audio prompt from the resource requesting entity and comparing the response to the authentication key.

18 Claims, 5 Drawing Sheets

(56) References Cited

U.S. PATENT DOCUMENTS

| | | | | |
|---|---|---|---|---|
| 2012/0016640 | A1* | 1/2012 | Murphy | G10K 15/02 703/2 |
| 2012/0144455 | A1 | 6/2012 | Lazar et al. | |
| 2012/0213375 | A1 | 8/2012 | Mahabub et al. | |
| 2012/0232907 | A1 | 9/2012 | Ivey | |
| 2014/0185823 | A1* | 7/2014 | Seligmann | H04R 27/00 381/92 |

OTHER PUBLICATIONS

Kan et al., "3DApe: A Real-Time 3D Audio Playback Engine", Proceedings of the 118th Audio Engineering Society Convention, May 26-31, 2005, Barcelona, Spain, 8 pages.

Tam et al., "Breaking Audio CAPTCHAs", Advances in Neural Information Processing Systems 21 (NIPS 2008), MIT Press, 8 pages.

www.longcat.fr/web/en/3d-audio-processing—1 pages.

* cited by examiner

SYSTEMS AND METHODS FOR THREE-DIMENSIONAL AUDIO CAPTCHA

FIELD

The present disclosure relates generally to CAPTCHAs. More particularly, the present disclosure relates to systems and methods for generating and providing a three-dimensional audio CAPTCHA.

BACKGROUND

Trust is an asset in web-based interactions. For example, a user must trust that an entity provides sufficient mechanisms to confirm and protect her identity in order for the user to feel comfortable interacting with such entity. In particular, an entity that provides a web-resource must be able to block automated attacks that attempt to gain access to the web-resource for malicious purposes. Thus, sophisticated authentication mechanisms that can discern between a resource request from a real human being and a request generated by an automated machine are a vital tool in developing the necessary relationship of trust between an entity and a user.

CAPTCHA ("completely automated public turing test to tell computers and humans apart") and audio CAPTCHA are two such authentication mechanisms. The goal of CAPTCHA and audio CAPTCHA is to exploit situations in which it is known that humans perform tasks better than automated machines. Thus, CAPTCHA and audio CAPTCHA preferably provide a prompt that is solvable by a human but generally unsolvable by a machine.

For example, a traditional CAPTCHA requires the resource requesting entity to read a brief item of text that serves as the authentication key. Such text is often blurred or otherwise disguised. Likewise, in audio CAPTCHA, which is suitable for visually-impaired users as well, the resource requesting entity is instructed to listen to an audio signal that includes the authentication key. The audio signal can be noisy or otherwise challenging to understand.

Both CAPTCHA and audio CAPTCHA are subject to sophisticated attacks that use artificial intelligence to estimate the authentication keys. In particular, with respect to audio CAPTCHA, the attacker can use Automated Speech Recognition (ASR) technologies to attempt to recognize a spoken authentication key.

Thus, a race exists between the audio CAPTCHA and ASR technologies. As such, designing secure and effective audio CAPTCHA requires the knowledgeable exploitation of situations where it is known that humans perform relatively well, while ASR systems do not. Therefore, systems and methods for providing an audio CAPTCHA that simulate situations in which humans have enhanced listening abilities versus ASR technology are desirable.

SUMMARY

Aspects and advantages of the invention will be set forth in part in the following description, or may be obvious from the description, or may be learned through practice of the invention.

One exemplary aspect of the present disclosure is directed to a system for generating an audio CAPTCHA prompt. The system can include a decoy signal database storing a plurality of decoy signals. The system can also include a three-dimensional audio simulation engine for simulating the sounding of a target signal and at least one decoy signal in an acoustic environment and outputting a stereophonic audio signal based on the simulation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
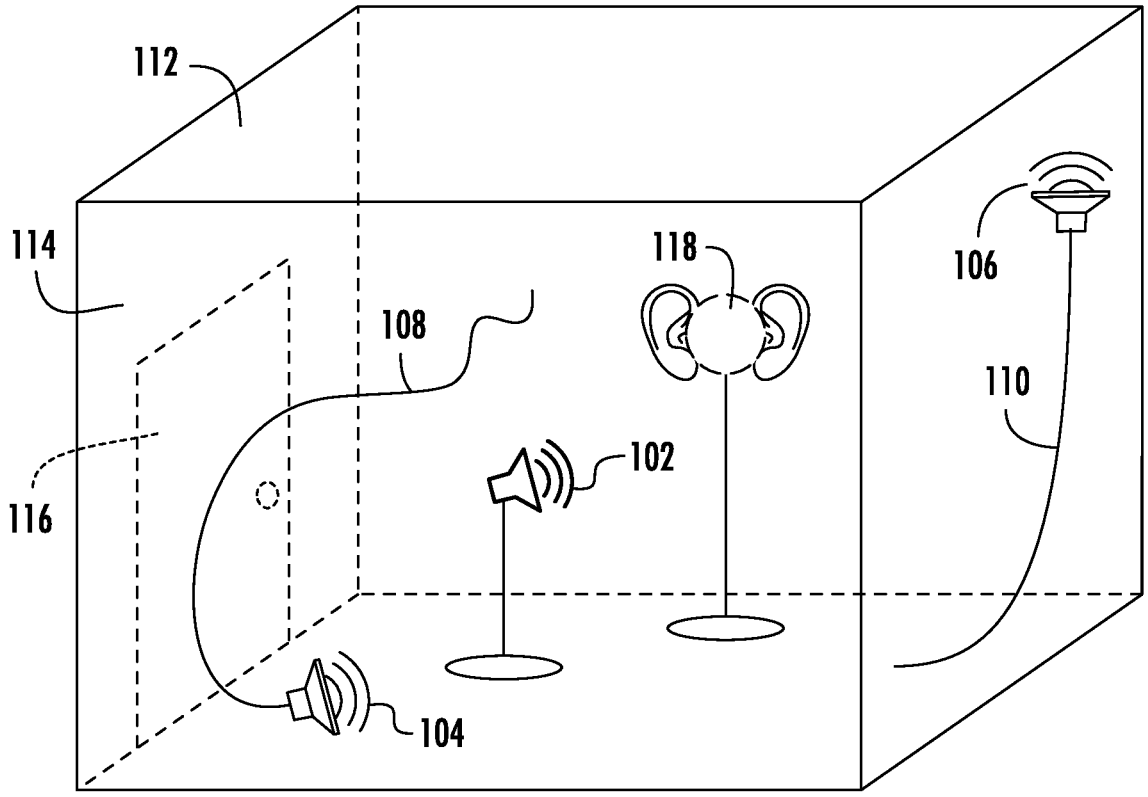
FIG. 1 depicts a diagram of an exemplary three-dimensional audio simulation according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Overview

Generally, the present disclosure is directed to systems and methods for generating a three-dimensional audio CAPTCHA ("completely automated public turing test to tell computers and humans apart"). In particular, the system constructs a stereophonic audio prompt that simulates a noisy and reverberant three-dimensional environment, such as a "cocktail party" environment, in which humans tend to perform well while ASR systems suffer severe performance degradations. The system combines one "target" signal with one or more "decoy" signals and uses a three-dimensional audio simulation engine to simulate the reverberation of the target and decoy signals within an acoustic environment of given characteristics. In order to pass the CAPTCHA, the resource requesting entity must be able to separate the content of the target signal from the decoy signals.

The target signal can be an audio signal that contains a human speech utterance. In particular, the target human speech utterance can be one or more words, phrases, characters, or other discernible content that includes or represents an authentication key. Generally, the authentication key is the correct or satisfactory answer to the audio CAPTCHA. The target signal may or may not contain introduced degradations or noise.

The decoy signals can be any audio signal provided as a decoy to the target signal. For example, decoy signals can be music signals, human speech signals, white noise, or other suitable signals. In one implementation, the decoy signals can be human speech utterances randomly selected or provided by a large multi-speaker multi-utterance database.

The decoy signals, and optionally the target signal as well, can remain in a fixed location or can change position about the acoustic environment according to given trajectories as the simulation progresses. Many factors associated with the decoy signals can be manipulated to provide unique and challenging CAPTCHA prompts, including, without limitation, the volume of the decoy signals and the trajectories associated with the decoy signals. More particularly, the shape, speed, and direction of emittance of the trajectories can be modified as desired.

The three-dimensional audio simulation engine can be used to simulate the sounding of the target signal and at least one decoy signal within the acoustic environment. As an example, the acoustic environment can be a virtual room described by a range of parameters such as the size and shape of the room, architectural elements or objects associated with the room such as walls, windows, or other reflection/absorption details.

The acoustic environment used to simulate the prompt can be generated by an acoustic environment generation module. In its simplest form, the module simply selects a predefined virtual room out of a database. In more elaborate forms, acoustic environments are modularly constructed by means of combining features or parameters, combining smaller virtual rooms, or randomizing room shapes or surface reflectiveness.

Thus, the three-dimensional audio simulation engine can be provided with a target speech signal and associated trajectory, one or more decoy speech signals and associated trajectories, and data describing an acoustic environment. The audio simulation engine uses transfer functions to simulate the reverberation of the signals within the acoustic environment. Further, head-related transfer functions can be used to simulate human spatial listening from a designated location within the acoustic environment.

The audio simulation engine can output a stereophonic audio signal based on the simulation. In particular, the outputted audio signal can be the simulated human spatial listening experience and can be used as the audio CAPTCHA prompt. As such, the systems and methods of the present disclosure can require a resource requesting entity to perform spatial listening in an environment where many other speakers talk at the same time, a situation in which humans exhibit superior abilities to ASR technology.

When a resource is requested from a resource provider, the audio CAPTCHA prompt can be provided by the resource provider to the resource requesting entity over a network. In order to pass the CAPTCHA, the resource requesting entity must isolate the authentication key from the remainder of the stereophonic audio signal output by the audio simulation engine and respond accordingly. The resource provider can include a response evaluation module for determining whether the resource requesting entity's response satisfies the CAPTCHA.

Exemplary Three-Dimensional Audio Simulation

FIG. 1 depicts a diagram of an exemplary three-dimensional audio simulation according to an exemplary embodiment of the present disclosure. In particular, FIG. 1 depicts a simulated sounding of a target signal 102 and decoy signals 104 and 106 in an acoustic environment 112. The result of such simulation can be a stereophonic audio signal simulating a human spatial listening experience from designated listening position 118. Such stereophonic audio signal can be used as a prompt in an audio CAPTCHA.

Target signal 102 can be an audio signal that contains an authentication key. As an example, the target signal can be an audio signal that includes a human speech utterance. In particular, the target human speech utterance can be one or more words, phrases, characters, or other discernible content that includes or represents the authentication key. Generally, the authentication key is the correct or satisfactory answer to the audio CAPTCHA.

For example, target signal 102 can be a human speech utterance of a string of letters, such as "U, L, R." As another example, target signal 102 can be a human speech utterance of a discernible phonetic phrasing that does not have a particular definition or semantic meaning, such as a nonsense word. As yet another example, target signal 102 can be crafted from one or more previously recorded audio signals, either alone or in combination, such as historic audio recordings of speeches, advertisements, or other content.

Target signal 102 may or may not contain introduced degradations or noise. Further, although target signal 102 is depicted in FIG. 1 as remaining stationary during the simulation, target signal 102 can change position according to an associated trajectory if desired.

Decoy signals 104 and 106 can be any audio signal used as a decoy for the target signal 102. Exemplary decoy signals 104 and 106 include, without limitation, human speech, music, background noise, city noise, jumbled speech, gibberish, white noise, text-to-speech signals generated by a speech synthesizer or any other audio signal, including random noise signals. In one implementation, decoy signals 104 and 106 can be human speech utterances randomly selected from a large multi-speaker, multi-utterance database. In a further implementation, decoy signals 104 and 106 can exhibit speech contours that are similar to target speech signal 102.

As shown in FIG. 1, decoy trajectories 108 and 110 can be respectively associated with decoy signals 104 and 106. Trajectories 108 and 110 can be straight, curved, or any other suitable trajectories. The inclusion of decoy trajectories 108 and 110 can enhance the difficulty of the resulting CAPTCHA by requiring the tested entity to spatially distinguish among audio signals moving throughout three-dimensional acoustic environment 112.

One of skill in the art, in light of the disclosures provided herein, will appreciate that various aspects of decoy signals 104 and 106 and associated trajectories 108 and 110 can be modified in order to increase or decrease the difficulty of the resulting CAPTCHA or to provide novel prompts. For example, the volume of decoy signals 104 and 106, as compared to target signal 102 or compared with each other, can be varied from one prompt to the next or within a single prompt.

As another example, a direction of emittance can be included in trajectories 108 and 110 and varied such that the direction at which the signal is emitted is not necessarily equivalent to the direction in which the trajectory is moving. For example, a decoy speech signal can be simulated such that the simulated speaker is facing designated listening position 118 but is walking backwards, or otherwise moving away from such position 118.

As yet another example, the rate at which the decoy signals 104 and 106 respectively change position according to trajectories 108 and 110 can be altered so that it is faster, slower, or changes speed during the simulation. In one implementation, trajectories 108 and 110 correspond to simulated decoy signal movement at about two kilometers per hour.

While two decoy signals 104 and 106 are depicted in FIG. 1, the present disclosure is not limited to such specific number of decoy signals. In particular, one decoy signal can be used. Generally, however, any number of decoy signals can be used.

In addition, the length or "run time" of decoy signals 104 and 106 need not match the exact run time of target signal 102. As such, any number of decoy signals can overlap. For example, the sounding of decoy signal 104 can be simulated only during the second half of the sounding of target signal 102. In other words, a decoy speech signal can simulate a decoy speaker entering acoustic environment 112 midway through target speech signal 102.

As another example, the audio prompt resulting from the simulation depicted in FIG. 1 can include a buffer portion in which only target signal 102 is audible. In particular, target signal 102 can be a human speech signal and the buffer portion can provide an opportunity for the target speaker to identify herself. For example, the target speaker can utter "Please follow my voice," prior to the introduction of decoy signals 104 and 106. In such fashion, the tested entity can be provided with an indication of which signal content he is required to isolate.

Acoustic environment 112 can be described by a plurality of environmental parameters. As an example, acoustic environment 112 can correspond to a virtual room defined by a plurality of room components including a room size, a room shape, and at least one surface reflectiveness.

As depicted in FIG. 1, acoustic environment 112 can include a plurality of modular features, such as a wall 114 and a structural element 116, shown here as a door. Wall 114 and structural element 116 can each exhibit a different surface reflectiveness. As such, the simulated sounding of target signal 102 and decoy signals 104 and 106 in acoustic environment 112 can produce unique three-dimensional reverberations that result in a challenging CAPTCHA prompt.

One of skill in the art, in light of the disclosures contained herein, will appreciate that acoustic environment 112, as depicted in FIG. 1 is simplified for the purposes of illustration and not for the purpose of limitation. As such, acoustic environment 112 can include many features or parameters that are not depicted in FIG. 1. Exemplary features include objects placed within acoustic environment 112, such as furniture or reflective blocks or spheres, or other structural features, such as windows, arches, openings to additional rooms, skylights, ceiling shapes, or other suitable structural features. In addition, the surface reflectiveness of parameters such as wall 114 can be randomized, patterned, or change during the simulation.

As will be discussed further with reference to FIG. 2, a three-dimensional audio simulation engine can be used to simulate the sounding of target signal 102 and decoy signals 104 and 106 in acoustic environment 112. In particular, the audio simulation engine can use head-related transfer functions to simulate a human spatial listening experience from designated listening position 118. The audio simulation engine can output an audio signal that corresponds to such simulated human spatial listening experience and such audio signal can be used as the CAPTCHA prompt.

Exemplary System for Generating Audio Prompt

Figure 2:
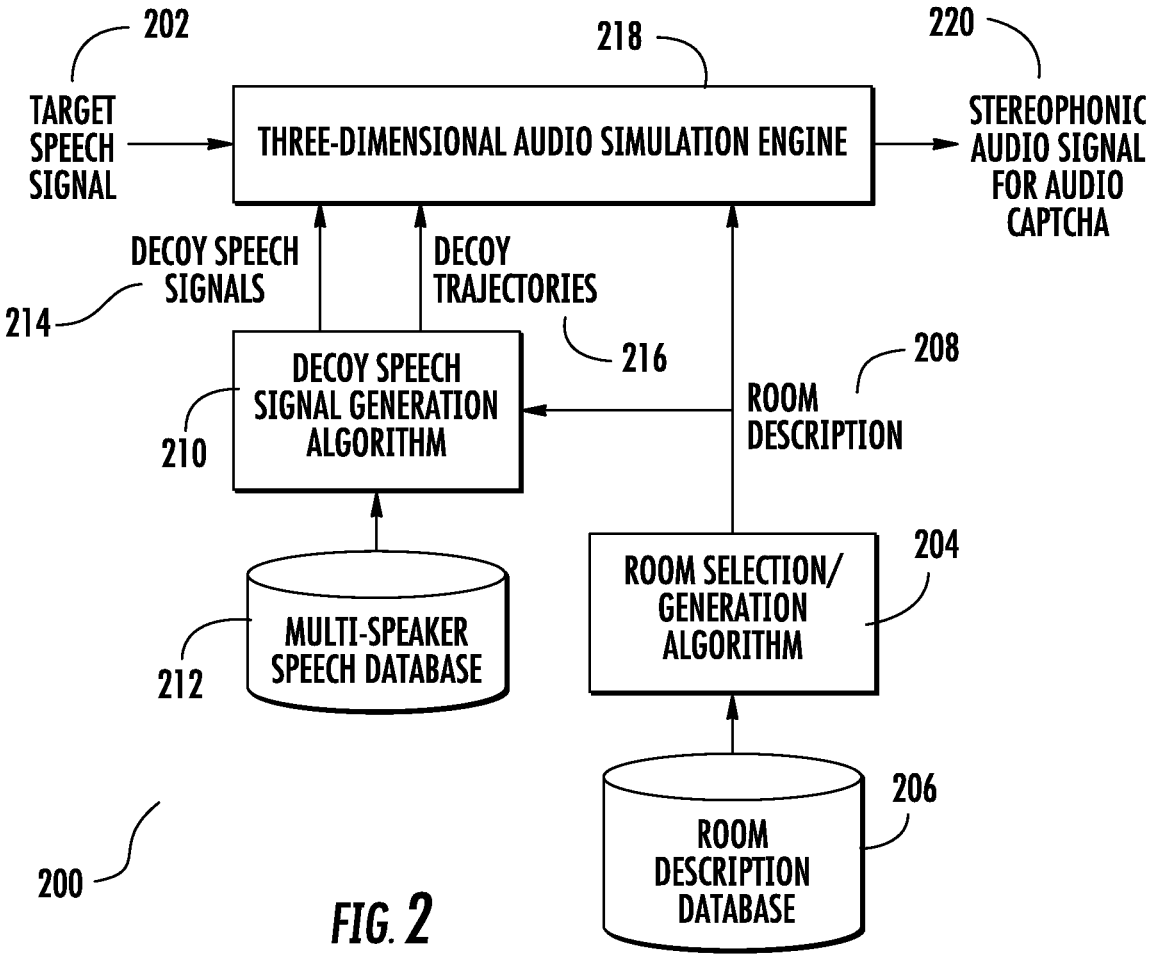
FIG. 2 depicts a block diagram of an exemplary system for generating an audio CAPTCHA prompt according to an exemplary embodiment of the present disclosure.

FIG. 2 depicts a block diagram of an exemplary system 200 for generating an audio CAPTCHA prompt according to an exemplary embodiment of the present disclosure. System 200 can perform a three-dimensional audio simulation similar to the exemplary simulation depicted in FIG. 1. In particular, system 200 can generate an audio CAPTCHA prompt based on such an audio simulation.

System 200 can include a three-dimensional audio simulation engine 218. Audio simulation engine 218 can perform three-dimensional audio simulations. In particular, a target speech signal 202, one or more decoy speech signals 214, one or more decoy trajectories 216, and a room description 208 can be used as inputs to audio simulation engine 218. Audio simulation engine 218 can output a stereophonic audio signal 220 to be used as an audio CAPTCHA based on a three-dimensional audio simulation.

Target speech signal 202 can be an audio signal that contains a human speech utterance. In particular, the target human speech utterance can be one or more words or phrases that include an authentication key. Such words need not be defined in a dictionary, but instead can simply be a collection of letters. Generally, the authentication key is the correct or satisfactory answer to the audio CAPTCHA. Target speech signal 202 may or may not contain introduced degradations or noise.

For example, target speech signal 202 can be a human speech utterance of a string of letters, such as "U, L, R." As another example, target speech signal 202 can be a human speech utterance of a discernible phonetic phrasing that does not have a particular definition or semantic meaning, such as a nonsense word. As yet another example, target speech signal 202 can be crafted from one or more previously recorded audio signals, either alone or in combination, such as historic audio recordings of speeches, advertisements, or other content.

Room description 208 can be data describing a multi-parametric acoustic environment. For example, room description 208 can describe a range of parameters, including, without limitation, a room size, a room shape, architectural or structural elements inside the room such as walls and windows, and reflecting and absorbing surfaces.

Room description 208 can be generated using a room generation algorithm 204. In its simplest form, room generation algorithm 204 randomly selects a predefined virtual room from a plurality of predefined virtual rooms stored in room description database 206.

In more elaborate implementations, room generation algorithm 204 modularly constructs room description 208 by selecting room components stored in room description database 206. For example, room description database 206 can store a plurality of room parameters, including room sizes, room shapes, and various degrees of surface reflectiveness. Room generation algorithm 204 can modularly select among such room parameters.

As a further example, room generation algorithm 204 can construct room description 208 randomly by means of combining smaller rooms and randomizing room shapes and surface reflectiveness.

One of skill in the art, in light of the disclosures contained herein, will appreciate that room description 208 can include many features or parameters in addition to those specifically described herein. Exemplary features include objects placed within the room, such as furniture or reflective blocks or spheres, or other structural features, such as windows, arches, openings to additional rooms, skylights, ceiling shapes, or other suitable structural features. In addition, the surface reflectiveness of parameters included in room description 208 can be randomized, patterned, or change during the simulation.

After room description 208 is generated by room generation algorithm 204, room description 208 is provided to a decoy speech signal generation algorithm 210 and three-dimensional audio simulation engine 218.

Decoy speech signal generation algorithm 210 is responsible for the selection of one or more decoy speech signals 214 and one or more corresponding decoy trajectories 216. Decoy speech signal generation algorithm 210 can randomly select one or more decoy speech signals from multi-speaker speech database 212.

Multi-speaker speech database 212 can be a database storing a plurality of human speech utterances respectively uttered by a plurality of human speakers. Such plurality of human speech utterances can be about equal numbers of utterances uttered by female speakers and utterances uttered by male speaker.

In addition, the plurality of human speech utterances can have been normalized with respect to sound levels using one or more sound level normalization algorithms. Further, the sound levels of the selected speech utterances can then be modified to fit a distribution of an average sound level of human speakers. In such fashion, the plurality of human speech utterances stored in multi-speaker speech database 212 can accurately mirror the spectrum of human speech.

As another example, multi-speaker speech database 212 can store a plurality of text-to-speech utterances generated by a synthesizer. Alternatively, the text-to-speech utterances can be generated in real-time by decoy speech signal generation algorithm 210. Further, the text-to-speech utterances can exhibit a speech contour similar to target speech signal 202. In such fashion, known weaknesses in ASR technology can be exploited.

Decoy speech signal generation algorithm 210 can also generate the one or more decoy trajectories 216. In some implementations, decoy speech signal generation algorithm 210 can take room description 208 into account when generating decoy trajectories 216.

Decoy trajectories 216 can be straight, curved, or any other suitable trajectories. The inclusion of decoy trajectories 216 can enhance the difficulty of the resulting CAPTCHA by requiring the tested entity to spatially distinguish among audio signals moving throughout three-dimensional room description 208.

Various aspects of decoy trajectories 216 can be modified in order to increase or decrease the difficulty of the resulting CAPTCHA or to provide novel prompts. For example, a direction of emittance can be included in trajectories 108 and 110 and varied such that the direction at which the signal is emitted is not necessarily equivalent to the direction in which the trajectory is moving. For example, a decoy speech signal 214 can be simulated such that the simulated speaker is facing a certain direction but is moving away from such position.

As yet another example, the speed of decoy trajectories 216 can be altered to be faster, slower, or change speed during the simulation. In one implementation, decoy trajectories 216 correspond to simulated decoy speech signal 214 moving at about two kilometers per hour.

Thus, three-dimensional audio simulation engine 218 receives target speech signal 202, one or more decoy speech signals 214, one or more decoy trajectories 216, and room description 208 as inputs. Audio simulation engine 218 simulates the sounding of the target speech signal 202 and the one or more decoy speech signals 214 in the room described by room description 208 as the decoy speech signals change position according to decoy trajectories 216.

More particularly, three-dimensional audio simulation engine 218 can implement pre-computed transfer functions that map the acoustic effects of the simulation. Such transfer functions can be fixed or time-varying. Three-dimensional audio simulation engine 218 can thus simulate the reverberation of the target and decoy signals throughout the room.

Three-dimensional audio simulation engine 218 can further implement pre-computed head-related transfer functions to simulate a human spatial listening experience. Such head-related transfer functions can be fixed or time-varying and serve to map the acoustic effects of human ears. In particular, the head-related transfer functions simulate the positioning of human ears such that a listening experience unique to humans can be simulated.

Three-dimensional audio simulation engine 218 can output the stereophonic audio signal 220 based on the simulation. In particular, audio signal 220 can be the result of simulating the human spatial listening experience from a designated location in the room. Audio signal 220 can be used as an audio CAPTCHA prompt.

Exemplary System for Performing Audio-Based Human Interactive Proof

Figure 3:
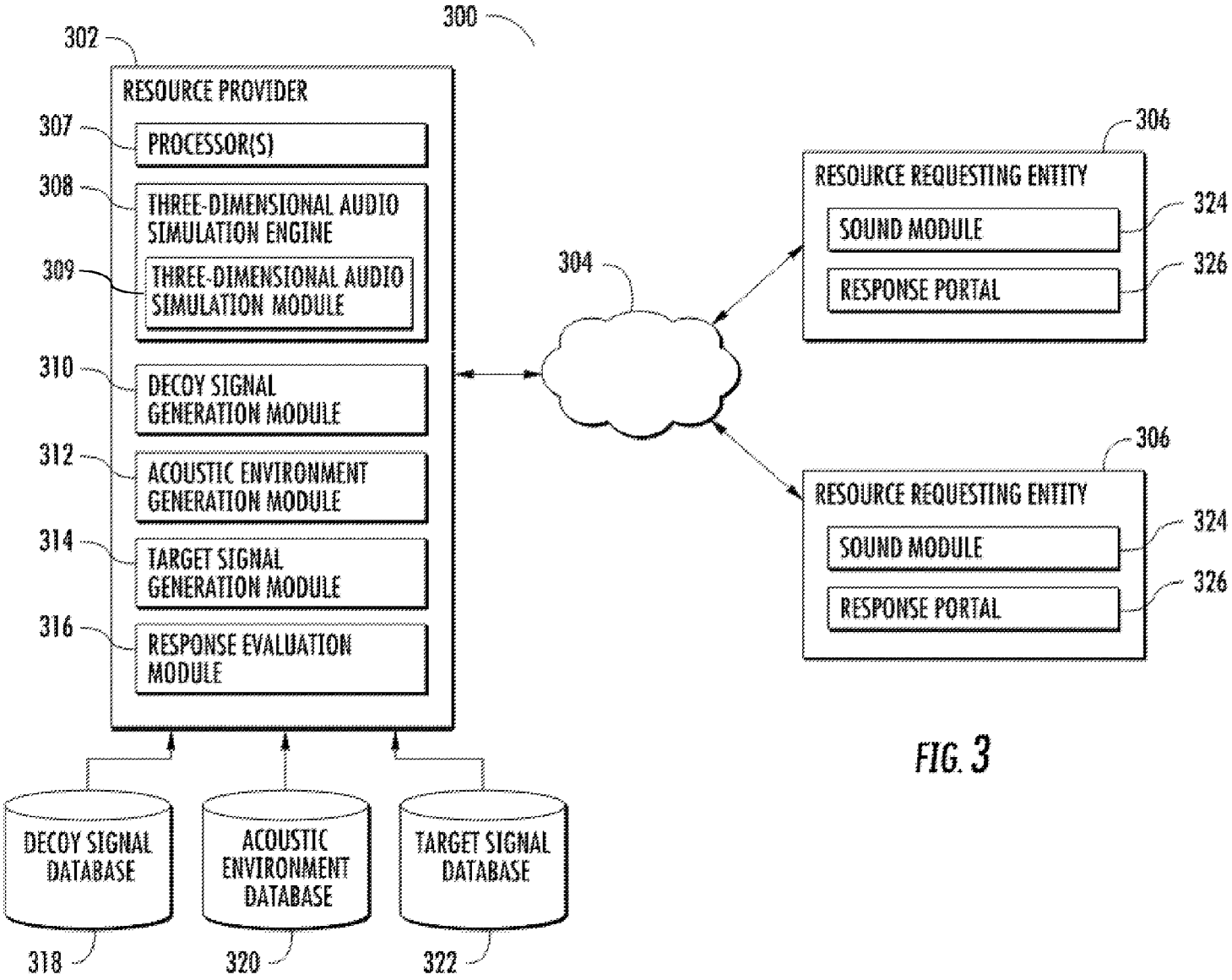
FIG. 3 depicts an exemplary system for performing an audio-based human interactive proof according to an exemplary embodiment of the present disclosure.

FIG. 3 depicts an exemplary system 300 for performing an audio-based human interactive proof according to an exemplary embodiment of the present disclosure. In particular, system 300 can include a resource provider 302 in communication with one or more resource requesting entities 306 over a network 304. Non-limiting examples of resources include a cloud-based email client, a social media account, software as a service, or any other suitable resource. However, the present disclosure is not limited to authentication for the purposes providing access to such a resource, but instead should be broadly applied to a system for performing an audio-based human interactive proof.

Generally, resource provider 302 can be implemented using a server or other suitable computing device. Resource provider 302 can include one or more processors 307 and other suitable components such as a memory and a network interface. Processor 307 can implement computer-executable instructions stored on the memory in order to perform desired operations.

Resource provider 302 can further include a three-dimensional audio simulation engine 308, a decoy signal generation module 310, an acoustic environment generation module 312, a target signal generation module 314, and a response evaluation module 316. The three-dimensional audio simulation engine 308 can include a three-dimensional audio simulation module 309 configured to simulate the sounding of a target signal and at least one decoy signal in an acoustic environment and output an audio signal based on the simulation. It will be appreciated that the term "module" refers to computer logic utilized to provide desired functionality. Thus, a module can be implemented in hardware, firmware and/or software controlling a general purpose processor. In one embodiment, the modules are program code files stored on a storage device, loaded into memory and executed by a processor or can be provided from computer program products, for example, computer executable instructions that are stored in a tangible computer-readable storage medium such as RAM hard disk or optical or magnetic media. The operation of modules 310, 312, 314, and 316 can be in accordance with principles disclosed above and will be discussed further with reference to FIGS. 4A and 4B.

Resource provider 302 can be in further communication with a decoy signal database 318, an acoustic environment database 320, and a target signal database 322. Such databases can be internal to resource provider 302 or can be externally located and accessed over a network such as network 304.

Network 304 can be any type of communications network, such as a local area network (e.g. intranet), wide area network (e.g. Internet), or some combination thereof. The network can also include a direct connection between a resource requesting entity 306 and resource provider 302. In general, communication between resource provider 302 and a resource requesting entity 306 can be carried via a network interface using any type of wired and/or wireless connection, using a variety of communication protocols (e.g. TCP/IP, HTTP, SMTP, FTP), encodings or formats (e.g. HTML, XML), and/or protection schemes (e.g. VPN, secure HTTP, SSL).

A resource requesting entity can be any computing device that requests access to a resource from resource provider 302. Exemplary resource requesting entities include, without limitation, a smartphone, a tablet computing device, a laptop, a server, or other suitable computing device. In addition, although two resource requesting entities 306 are depicted in FIG. 3, one of skill in the art, in light of the disclosures provided herein, will appreciate that any number of resource requesting entities can request access to a resource from resource provider 302. Depending on the application, hundreds, thousands, or even millions of unique resource requesting entities may request access to a resource a daily basis.

Generally, a resource requesting entity 306 contains at least two components in order to operate with the system 300. In particular, a resource requesting entity 306 can include a sound module 324 and a response portal 326. Sound module 324 can operate to receive an audio prompt from resource provider 302 and provide functionality so that the audio prompt can be listened to. For example, sound module 324 can include a plug-in sound card, a motherboard-integrated sound card or other suitable components such as a digital-to-analog converter and amplifier. Generally, sound module 324 can also include means for creating sound such as headphones, speakers, or other suitable components or external devices.

Response portal 326 can operate to receive a response from the resource requesting entity and return such response to resource provider 302. For example, response portal 326 can be an HTML text input field provided in a web-browser. As another example, response portal can be implemented using any variety of common technologies including Java, Flash, or other suitable applications. In such fashion, a resource requesting entity can be tested with audio prompt using sound module 324 and return a response via response portal 326.

Exemplary Method for Testing a Resource Requesting Entity

Figure 4A:
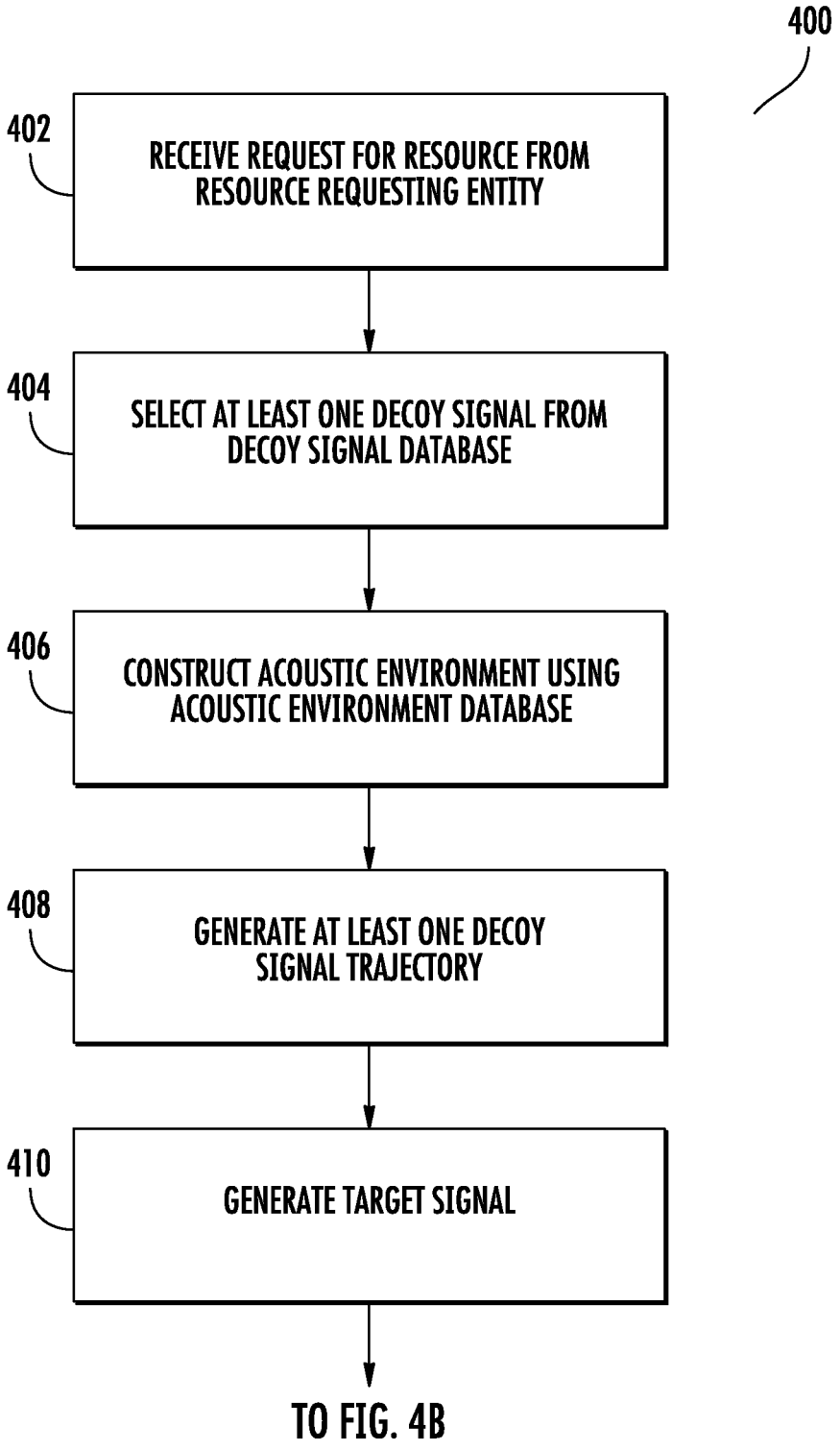
FIGS. 4A and 4B depict a flow chart of an exemplary method for testing a resource requesting entity according to an exemplary embodiment of the present disclosure.
Figure 4B:
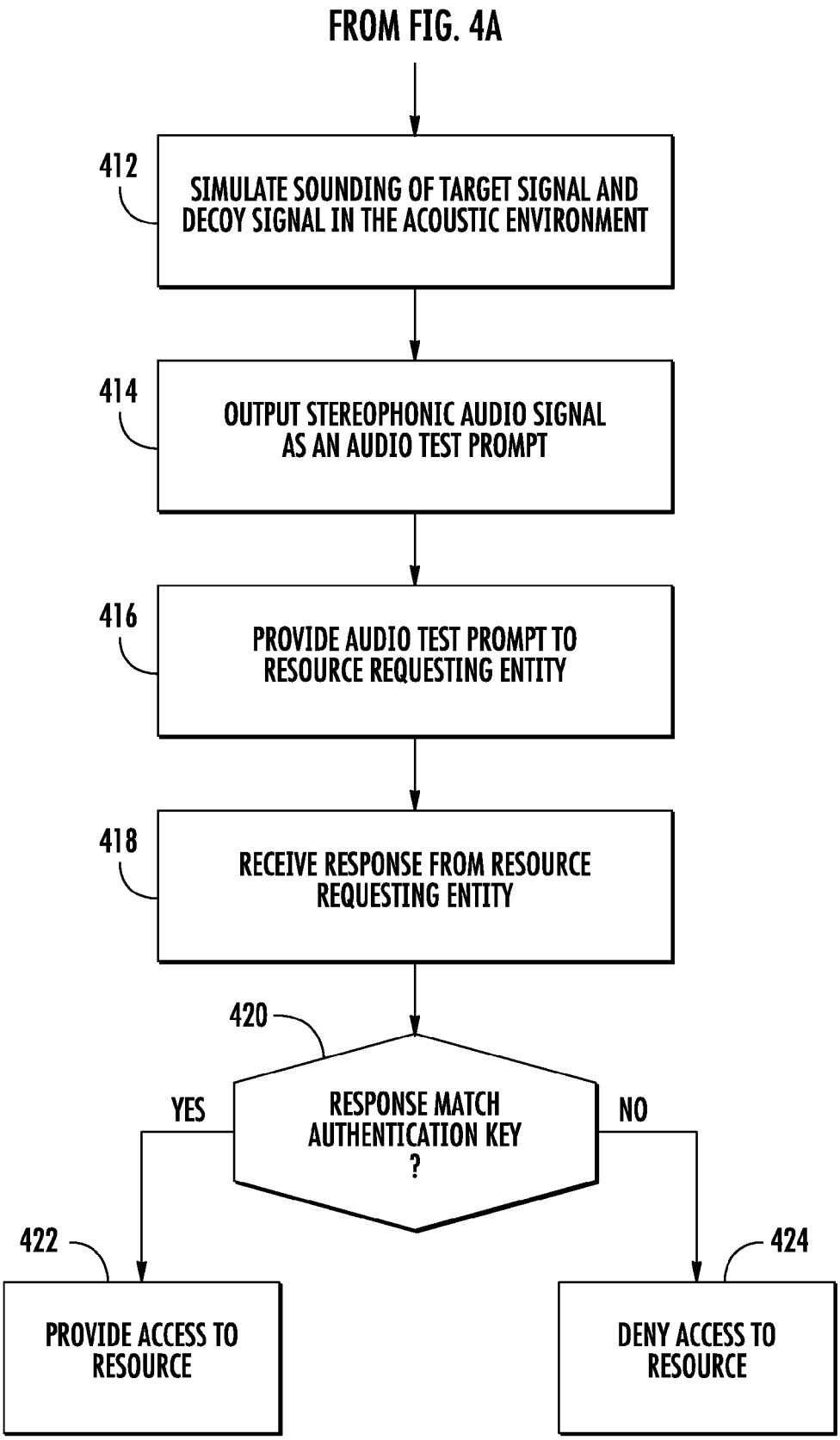

FIGS. 4A and 4B depict a flow chart of an exemplary method (400) for testing a resource requesting entity according to an exemplary embodiment of the present disclosure. Although exemplary method (400) will be discussed with reference to exemplary system 300, exemplary method (400) can be implemented using any suitable computing system. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

Referring to FIG. 4A, at (402) a request for a resource is received from a resource requesting entity. For example, resource provider 302 can receive a request to access a resource from a resource requesting entity 306 over network 304.

At (404) at least one decoy signal is selected from a decoy signal database. For example, decoy signal generation module 310 can select at least one decoy signal from decoy signal database 318.

At (406) an acoustic environment is constructed using an acoustic environment database. For example, acoustic environment generation module 312 can construct an acoustic environment using acoustic environment database 320. In one implementation, acoustic environment database can store data describing a plurality of virtual room components and acoustic environment generation module can modularly select such virtual room components to generate the acoustic environment.

At (408) at least one decoy signal trajectory is generated. For example, decoy signal generation module 310 can generate at least one trajectory to associate with the at least one decoy signal selected at (404). In some implementations, decoy signal generation module 310 can take into account the acoustic environment constructed at (406) when generating the trajectory at (408).

At (410) a target signal is generated that includes an authentication key. As an example, target signal generation module 314 can generate a target signal using target signal database 322.

Referring now to FIG. 4B, at (412) the sounding of the target signal generated at (410) and the decoy signal selected at (404) in the acoustic environment constructed at (406) is simulated. For example, three-dimensional audio simulation engine 308 can use transfer functions to simulate the sounding of the target signal and the decoy signal in the acoustic environment as the decoy signal changes position according to the trajectory generated at (408). In particular, three-dimensional audio simulation engine 308 can user head related transfer functions to simulate a human spatial listening experience from a designated location in the acoustic environment.

At (414) a stereophonic audio signal is output as an audio test prompt. For example, three-dimensional audio simulation engine 308 can output a stereophonic audio signal based on the simulation performed at (412). In particular, the outputted audio signal can be the simulated human spatial listening experience. The outputted audio signal can be used as an audio test prompt.

At (416) the audio test prompt is provided to the resource requesting entity. For example, resource provider 302 can transmit the stereophonic audio signal output at (414) over network 304 to the resource requesting entity 306 that requested the resource at (402).

At (418) a response is received from the resource requesting entity. For example, resource provider 302 can receive over network 304 a response provided by the resource requesting entity 306 that was provided with the audio test prompt at (416). In particular, the resource requesting entity 306 can implement a response portal 324 in order to receive a response and transmit such response over network 304.

At (420) it is determined whether the response received at (418) satisfactorily matches the authentication key included in the target signal generated at (410). For example, resource provider 302 can implement response evaluation module 316 to compare the response received at (418) with the authentication key.

If it is determined at (420) that the response received at (418) satisfactorily matches the authentication key, then the resource requesting entity is provided with access to the resource at (422). However, if it is determined at (420) that the response received at (418) does not satisfactorily match the authentication key, then resource requesting entity is denied access to the resource at (424).

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A system for generating an audio CAPTCHA (Completely Automated Public Turing test to tell Computers and Humans Apart) prompt, the system comprising:

a decoy signal database that stores a plurality of decoy signals, the decoy signal database comprising at least one non-transitory computer-readable medium; and a three-dimensional audio simulation engine that simulates the sounding of a target signal and at least one decoy signal in an acoustic environment and outputs a stereophonic audio signal based on the simulation, the stereophonic audio signal usable as the audio CAPTCHA prompt;

wherein to simulate the sounding of the target signal and the at least one decoy signal in the three-dimensional acoustic environment, the three-dimensional audio simulation engine:

simulates the reverberation of the target signal and the at least one decoy signal within the acoustic environment; and uses head-related transfer functions to simulate a human spatial listening experience from a designated location in the acoustic environment; and wherein the decoy signal is a first audio speech signal and the target signal is a second audio speech signal containing an authentication key.

2. The system of claim 1, further comprising a decoy signal generation module that randomly selects the at least one decoy signal from the decoy signal database.

3. The system of claim 2, wherein:

the decoy signal generation module generates a trajectory for the at least one decoy signal, the trajectory describing a position versus time; and the three-dimensional audio simulation engine simulates the sounding of the at least one decoy signal as the decoy signal changes position according to the trajectory.

4. The system of claim 1, wherein the plurality of decoy signals stored in the decoy signal database comprise a plurality of human speech utterances respectively uttered by a plurality of human speakers.

5. The system of claim 1, further comprising:

an acoustic environment database that stores data that describes a plurality of environmental parameters; and an acoustic environment generation module that generates the acoustic environment from the data stored in the acoustic environment database.

6. The system of claim 5, wherein the data that describes the plurality of environmental parameters stored in the acoustic environment database comprises data that describes a plurality of virtual rooms.

7. The system of claim 5, wherein the data that describes the plurality of environmental parameters stored in the acoustic environment database comprises data that describes a plurality of modular room components, the plurality of modular room components including a size, a shape, and at least one surface reflectiveness.

8. The system of claim 1, wherein the stereophonic audio signal output by the three-dimensional audio simulation engine based on the simulation comprises a simulated human spatial listening experience from a designated position within the acoustic environment.

9. The system of claim 1, further comprising:

a decoy signal generation module that provides at least one decoy signal from the decoy signal database;

a target signal generation module that provides a target signal; and an acoustic environment generation module that provides data describing an acoustic environment;

wherein the three-dimensional audio simulation engine comprises a three-dimensional audio simulation module that simulates the sounding of the target signal and the at least one decoy signal in the acoustic environment and outputs an audio signal based on the simulation.

10. The system of claim 1, wherein the target signal which contains the authentication key comprises a human speech utterance that verbalizes the authentication key.

11. The system of claim 1, further comprising:

a response evaluation module that, when implemented by one or more processors, compares a response received from a user to be authenticated to the authentication key.

12. The system of claim 1, wherein at least one of the plurality of decoy signals comprises a text-to-speech signal generated by a synthesizer.

13. The system of claim 1, further comprising:

a text-to-speech synthesizer that respectively generates the plurality of decoy signals from a plurality of textual strings.

14. A method for generating an audio CAPTCHA (Completely Automated Public Turing test to tell Computers and Humans Apart) prompt, the method comprising:

receiving, by one or more computing devices, at least one decoy signal, data describing an acoustic environment, and a target signal wherein the decoy signal is a first audio speech signal and the target signal is a second audio speech signal containing an authentication key;

simulating, by one or more computing devices, the sounding of the target signal and the at least one decoy signal in the acoustic environment, wherein simulating, by one or more computing devices, the sounding of the target signal and the at least one decoy signal in the acoustic environment comprises:

simulating, by one or more computing devices, the reverberation of the target signal and the at least one decoy signal within the acoustic environment; and using, by one or more computing devices, head-related transfer functions to simulate a human spatial listening experience from a designated location in the acoustic environment; and outputting, by one or more computing devices, a stereophonic audio signal based on the simulation.

15. The method of claim 14, further comprising:

receiving, by one or more computing devices, at least one trajectory associated with the at least one decoy signal, the trajectory describing a position versus time, wherein simulating, by one or more computing devices, the sounding of the at least one decoy signal in the acoustic environment comprises simulating, by one or more computing devices, the sounding of the at least one decoy signal in the acoustic environment as the decoy signal changes position according to the trajectory.

16. The method of claim 14, further comprising:

providing, by one or more computing devices, the stereophonic audio signal to a resource requesting entity as a CAPTCHA prompt.

17. The method of claim 14, further comprising:

randomly selecting, by one or more computing devices, the at least one decoy signal from a decoy signal database; and modularly selecting, by one or more computing devices, the data describing the acoustic environment from an acoustic environment database, the acoustic environment database storing data describing a plurality of modular room components.

18. The method of claim 14, wherein the stereophonic audio signal comprises the simulated human spatial listening experience.

* * * * *